United States Patent [19]

Scruggs et al.

[11] Patent Number: 4,486,926

[45] Date of Patent: Dec. 11, 1984

[54] CARPET CUTTING DEVICE

[75] Inventors: Major B. Scruggs, LaGrange, Ga.; Robert C. Fay, Spartanburg, S.C.

[73] Assignee: Milliken Research Corporation, Spartanburg, S.C.

[21] Appl. No.: 446,329

[22] Filed: Dec. 2, 1982

[51] Int. Cl.[3] ..... D06C 13/10

[52] U.S. Cl. ..... 26/13; 139/21

[58] Field of Search ..... 26/13, 14; 83/676; 139/21, 291 C

[56] References Cited

U.S. PATENT DOCUMENTS

| | | | |
|---|---|---|---|
| 13,862 | 12/1855 | Bigelow | 26/13 |
| 359,048 | 3/1887 | Bacon | 26/14 |
| 368,618 | 8/1887 | Proctor | 83/676 X |
| 522,931 | 7/1894 | Corzilius | 26/14 |
| 3,957,568 | 5/1976 | Abel | 26/13 X |
| 3,972,254 | 8/1976 | Dillinger et al. | 26/13 X |

FOREIGN PATENT DOCUMENTS

| | | | |
|---|---|---|---|
| 253930 | 11/1912 | Fed. Rep. of Germany | 26/13 |
| 604522 | 10/1934 | Fed. Rep. of Germany | 26/13 |
| 657094 | 1/1929 | France | 26/13 |
| 2949 | of 1873 | United Kingdom | 26/13 |
| 11169 | of 1885 | United Kingdom | 26/13 |
| 24494 | of 1894 | United Kingdom | 26/13 |
| 3021 | of 1904 | United Kingdom | 26/13 |
| 1100969 | 1/1968 | United Kingdom | 26/14 |

*Primary Examiner*—Robert R. Mackey

*Attorney, Agent, or Firm*—Earle R. Marden; H. William Petry

[57] ABSTRACT

A reciprocating web cutting knife which employs a fixed rotary knife blade which is indexed upon each full reciprocation of the knife carriage. A ratchet and pawl arrangement cooperates with a ratchet wheel mounted on the knife to index the knife.

2 Claims, 5 Drawing Figures

CARPET CUTTING DEVICE

This invention relates in general to a device for cutting a moving substrate in which the cutting blade is indexed periodically to increase the service life of the blade.

Therefore, it is an object of the invention to provide a cutting device in which the cutting blade is periodically indexed to present a different cutting surface to the material being cut.

Other objects of the invention will become readily apparent as the specification proceeds to describe the invention with reference to the accompanying drawings, in which.

Figure 1:
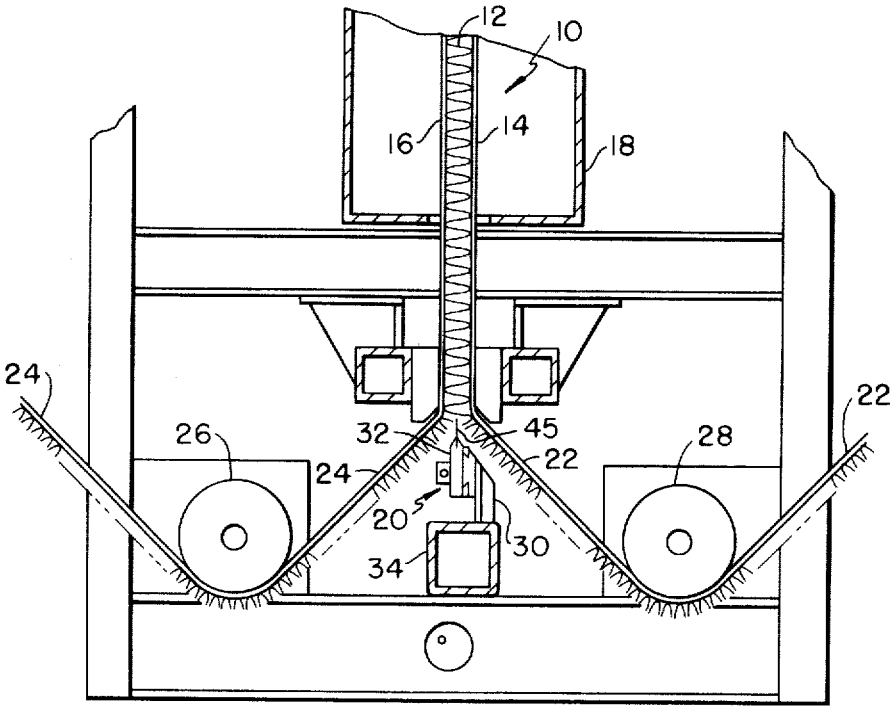
FIG. 1 is an end elevation view of a portion of the new and improved cutting machine.

In the preferred form of the invention the new and novel cutter mechanism is being employed on a bonded carpet fabric 10 as shown in FIG. 1 and manufactured as disclosed in U.S. Pat. No. 3,785,906. Briefly the carpet fabric 10 consists of a plurality of carpet yarns 12 folded in a zig-zag fashion with the apices imbedded in adhesive coated carpet backing webs 14 and 16. The carpet 10 is delivered downward from the forming portion of the machine shown in U.S. Pat. No. 3,785,906 into a curing oven 18. Mounted below the curing oven 18 is a reciprocating knife mechanism 20 which splits the carpet 10 into two carpet segments 22 and 24 which are guided away from the carpet machine by rolls 26, 28 respectively.

Figure 4:
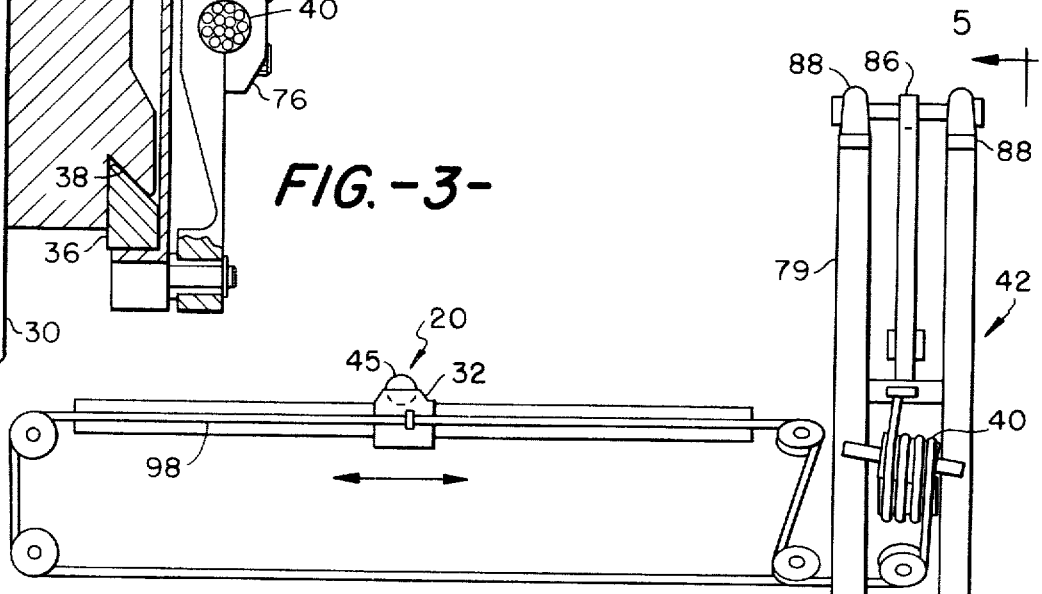
FIG. 4 is a schematic front view of the cutter machine.
Figure 5:
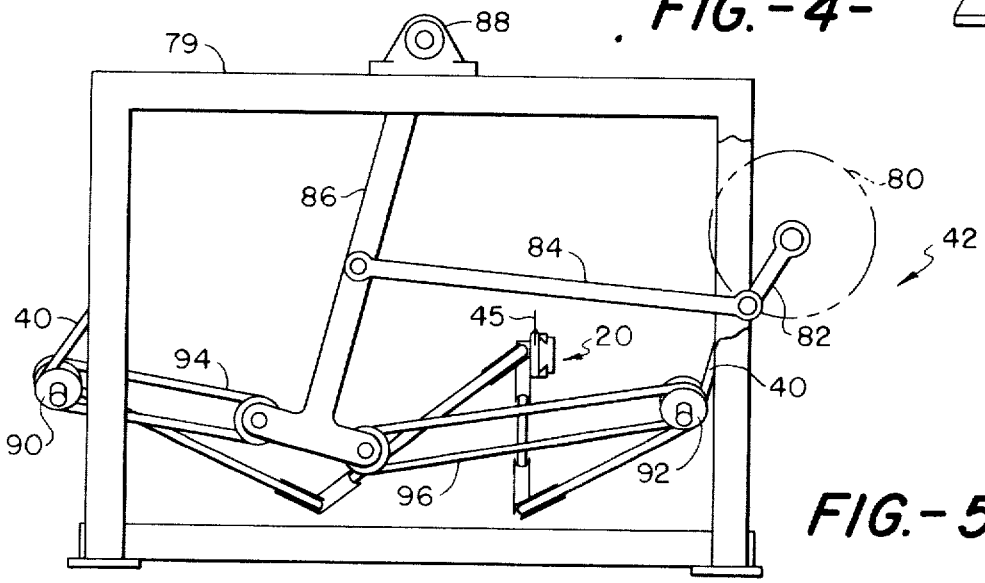
FIG. 5 is an end view taken on line 5—5 of FIG. 4 showing the cutter pulley arrangement.

The reciprocating knife mechanism 20 consists basically of two components 30 and 32 with the component 30 being fixed to the support member 34 attached to the carpet machine and the component 32 slideably mounted on the fixed component 30. As shown in detail in FIG. 3, the component 32 has triangular shaped members or tongues 36 connected to the back thereof which engage mating grooves 38 in the fixed component 30 to form a sliding tongue and groove connection to guide the sliding component 32 as it is pulled back and forth by the rope or strand 40. The rope or strand 40 is driven by the drive arrangement 42 shown in FIGS. 4 and 5 mounted at one end and separate from the carpet machine.

Figure 2:
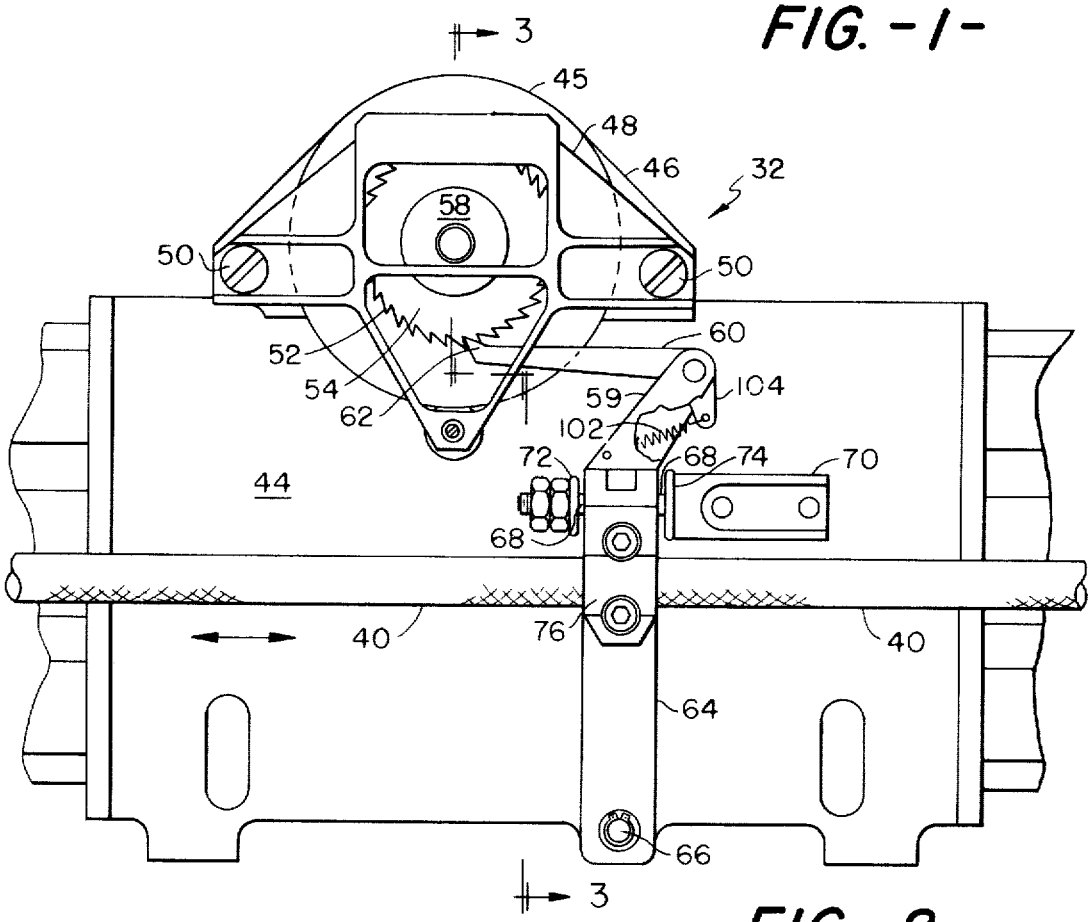
FIG. 2 is a front view of the cutter arrangement mounted on the carriage body.
Figure 3:
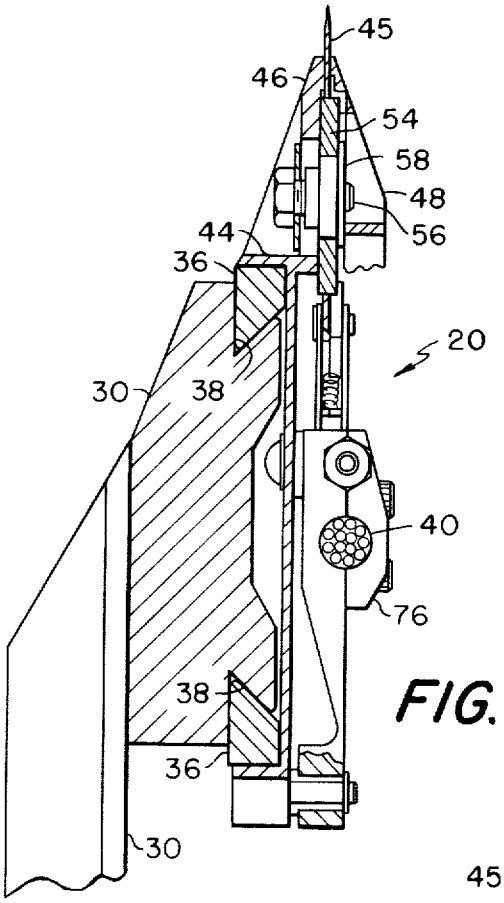
FIG. 3 is a section view taken generally on line 3—3 of FIG. 2.

Looking now basically to FIGS. 2 and 3, the sliding component 32 is shown in detail. The sliding component 32 has a rectangular support plate or carriage 44 on the back of which are mounted the tongues 36. The cylindrical cutting blade 45 is supported between the back blade support member 46 integral with the support plate 44 and the blade support member 48 held thereagainst by suitable screws 50 or other means connected to the back blade support member 46. The cutting blade 45 has an opening therein with internal notches which mate with the teeth 52 of the ratchet wheel 54 held in the opening by means of the screw 56 which engages the hub 58 of the ratchet wheel 54. Pivotally connected to the lever arm extension 59 is the ratchet pawl 60 which has its outer extremity 62 in engagement with one of the teeth 52 of the ratchet wheel 54. The lever extension 59 is connected to the lever arm 64 pivotally connected at 66. The upper portion of the lever arm 64 has a hole therein through which projects the guide bar 68 of the stop member 70 connected to the support plate 44. The cylindrical bushings 72 and 74 also telescoping the guide bar 68 limit the pivotal movement of the lever arm 64. Connected to the front of the lever arm 64 by suitable means 76 is the rope or strand 40 which reciprocates the sliding cutting component 32.

The sliding component 32 is reciprocated back and forth by the rope or strand 40 to sever the carpet fabric 10 into the individual carpet segments 22 and 24 as shown in FIG. 1. As previously mentioned, the rope 40 is driven by the drive arrangement 42 shown in detail in FIGS. 4 and 5. The drive arrangement 42 is a free standing frame arrangement 79 which supports an eccentric drive member 80 synchronized with the feed rolls of the carpet machine to cause the crank arms 82 and 84 to reciprocate the lever pulley arm 86 mounted in suitable bearings 88 on the top of the frame arrangement 79. One end of the rope is secured to one end of the frame 79 and the other end of the rope is secured to the other end of the frame 79. Through the main guide pulleys 90 amd 92, the loops 94 and 96 of the rope 40 will increase and decrease in length. Looking at FIG. 5, as the loop 94 decreases in length the upper portion 98 of the rope 40 in FIG. 4 will lengthen and slide the sliding component 32 to the left. Conversely, as the loop 94 increases in length and the loop 96 decreases in length the sliding component will be pulled to the right.

Looking now to FIG. 2, it can be seen that as the sliding component 32 is moved to the right, the lever arm 60 will pivot clockwise to pull the ratchet pawl 60 to the right thereby disengaging the ratchet pawl extremity 62 from one tooth 52 and move it towards the next tooth 52 on the ratchet wheel 54. When the extremity 62 moves adjacent the next tooth 52, the spring 102 connected to the short lever arm 104 will move the extremity into engagement with the tooth. Then when the sliding component 32 is slid to the left the knife blade 45 will be rotated or indexed by the engagement of the panel extremity with the tooth 52 of the ratchet wheel 54. It is understood that the sliding component is being moved back and forth to sever the yarns 12 of the carpet fabric 10 to produce the individual carpet segments 22 and 24. The spacing between the bushings 72 and 74 is so selected to limit the travel of the lever arm 64 so that the pawl is moved only around one tooth 52 of the ratchet wheel on one complete reciprocation of the sliding component 32 of the cutting device.

It can readily be seen that on one complete cutting stroke of the fixed cutting blade, the cutting blade is incrementally indexed in order to reduce wear on any one portion of the blade. This indexing of the cutting blade provides longer blade life and thereby reduces labor cost and product defects due to the longer length of time between blade replacements.

Although the preferred embodiment of the invention has been described it is contemplated that changes may be made without departing from the scope of the invention and we desire to be limited only by the scope of the claims.

We claim:

1. A cutter apparatus comprising: a fixed support member having a track therein, a sliding cutter means having means engaging said track to allow said cutter means to be slid in said track, a substantially cylindrical cutting blade fixed to said cutter means, a first means operably associated with said cutter means to slide said cutter means back and forth in said track and an indexing means connected to said cutter means to cause said cutting blade to be indexed upon being slid back and forth by said first means, said indexing mean including a ratchet wheel connected to said cutting blade and a pawl operably associated with said ratchet wheel, said indexing means also including a lever arm pivotally connected to said cutter means at one end and to said pawl at the other end, said indexing means including stop means located on both sides of said lever arm and connected to said cutter means to limit the pivotal movement of said lever arm to allow said pawl to index said cutting blade incrementally upon each complete reciprocation of said cutter means.

2. An apparatus to separate a carpet fabric having two facing backings spaced from one another by yarn connected thereto into two separate carpet like fabrics comprising: means to supply the carpet fabric in a downward direction, a cutting means reciprocably mounted in the path of travel of the carpet fabric, said cutting means having a circular, fixed cutting blade projecting upward into the path of travel of the carpet fabric, means to reciprocate the cutting means in contact with the yarn in the carpet fabric and an indexing means operably associated with said cutting means to automatically index said cutting blade upon reciprocation of said cutting means, said indexing means including a ratchet wheel connected to said cutting blade and a pawl operably associated with said ratchet wheel, said indexing means also including a lever arm pivotally connected to said cutting means at one end and to said pawl at the other end, said indexing means including stop means located on both sides of said lever arm and connected to said cutting means to limit the pivotal movement of said lever arm to allow said pawl to index said cutting blade incrementally upon each complete reciprocation of said cutting means.

* * * * *